US005536607A

United States Patent [19]

Ohashi et al.

[11] Patent Number: 5,536,607

[45] Date of Patent: Jul. 16, 1996

[54] IMAGE CORRECTING METHOD USING AN ELECTROPHOTOGRAPHIC PHOTORECEPTOR

[75] Inventors: Kunio Ohashi; Mitsuru Tokuyama, both of Nara; Hiroshi Kinashi, Kyoto; Mamoru Nozomi, Kanagawa; Tadashi Umehara, Niigata; Toshiya Asari, Kanagawa, all of Japan

[73] Assignees: Mitsubishi Kasei Corporation, Tokyo; Sharp Kabushiki Kaisha, Osaka, both of Japan

[21] Appl. No.: 148,921

[22] Filed: Nov. 5, 1993

[30] Foreign Application Priority Data

Nov. 5, 1992 [JP] Japan ..... 4-296132

[51] Int. Cl.[6] ..... G03G 5/10

[52] U.S. Cl. ..... 430/30; 430/945; 346/108; 347/139

[58] Field of Search ..... 430/30, 945; 346/160, 346/108; 355/208

[56] References Cited

U.S. PATENT DOCUMENTS 5,175,570 12/1992 Haneda et al. ..... 346/160

5,291,223 3/1994 Ogane et al. ..... 346/108

FOREIGN PATENT DOCUMENTS

| | | |
|---|---|---|
| 0139448 | 5/1985 | European Pat. Off. . |
| 0462439 | 12/1991 | European Pat. Off. . |
| 0472172 | 2/1992 | European Pat. Off. . |
| 58-185868 | 12/1983 | Japan . |
| 60-260067 | 12/1985 | Japan . |
| 62-87978 | 4/1987 | Japan . |
| 63-64055 | 3/1988 | Japan . |

OTHER PUBLICATIONS

Patent Abstracts of Japan, vol. 9, No. 329, Dec. 24, 1985.
Patent Abstracts of Japan, vol. 9, No. 250, Oct. 8, 1985.
Database WPI, Section Ch, Week 8824.

*Primary Examiner*—John Goodrow
*Attorney, Agent, or Firm*—Sughrue, Mion, Zinn, Macpeak & Seas

[57] ABSTRACT

An electrophotographic photoreceptor comprising a cylindrical electrically conductive substrate having thereon at least a photoconductive layer, the conductive substrate having a marking portion in which the light reflectance of the surface of the conductor substrate has been changed by a laser light treatment, a method for producing the photoreceptor, and an image correcting method using the photoreceptor.

2 Claims, 1 Drawing Sheet

IMAGE CORRECTING METHOD USING AN ELECTROPHOTOGRAPHIC PHOTORECEPTOR

FIELD OF THE INVENTION

The present invention relates to an electrophotographic photoreceptor, a method of producing the photoreceptor, and an image-correcting method using the photoreceptor. More specifically, the present invention relates to an electrophotographic photoreceptor capable of obtaining the same good image qualities as the initial image quality even after the repeated use of the photoreceptor, a method of producing the photoreceptor, and an image-correcting method using the photoreceptor.

BACKGROUND OF THE INVENTION

Since an electrophotographic technique achieves instant image-formation and provides images of high quality, the electrophotographic technique has been recently widely used not only in the field of copying machines but also in the field of various kinds of printers.

As the photoreceptor which is an essential member of the electrophotographic technique, photoreceptors using organic photoconductive materials (hereinafter referred to as organic photoreceptors) having advantages of no pollution problem, easy film-formation, easy production thereof, etc., have been recently developed in place of the inorganic photoconductors such as selenium, an arsenic-selenium alloy, cadmium sulfide, zinc oxide, etc., which have hitherto been used as the photoconductive materials.

In the organic photoreceptors, a laminated layer type photoreceptor comprising a charge generating layer and a charge transfer layer laminated each other is developed and has mainly been subjected to the investigations.

The laminated layer type photoreceptor has a high possibility of becoming the main subject of photoreceptors and has been positively developed, because the photoreceptor having a high sensitivity can be obtained by combining a charge generating layer and a charge transport layer each having a high efficiency, the photoreceptor having a wide selective range of materials and having a high safety can be obtained, the productivity of layer coating is high, and the photoreceptor is relatively advantageous in cost.

However, the laminated layer type photoreceptors which have hitherto been practically used have various problems in the electric characteristics that the light sensitivity is insufficient, the residual electric potential is high, and the light responsive property is poor. Further, it suffers problems upon repeated use that the charging property is lowered, the residual electrostatic charges are accumulated, the sensitivity is deviated, etc. The conventional laminated layer type photoreceptors therefore could not have sufficient characteristics. In these problems, the deterioration caused by repeated use of the photoreceptor, i.e., the deterioration of the charging property and the sensitivity caused by the increase of the residual potential, the wear of the photosensitive layer by the abrasion of the layer in the cleaning step in the electrophotographic process, etc., directly causes lowering of the image quality, whereby such a laminated layer type photoreceptor does not have a sufficient printing durability at present. Accordingly, in order to use an organic photoreceptor for an electrophotographic process of high speed, it is very important in the practical use for increasing the reliability of the copying machine to always form stable images through compensation of the image quality deterioration due to the deterioration of the photoreceptor by controlling the electrophotographic process.

Examples of such a process controlling method include a method of timely detecting the surface potential of the photoreceptor by setting a surface electrometer in a copying machine and optimally controlling the output of the electrostatically charging device and the voltage of the copy lamp according to the result of the detection; and a method of forming a latent image of standard white on a photoreceptor, developing the latent image thus printed with a toner, detecting the density of the toner image by an optical sensor, and optimally controlling the output of the electrostatic charging device, the toner concentration of the developer, the developing bias potential, and the copy lamp voltage according to the result of the detection.

However, when the latter method was attempted for example, a sufficient image was not obtained. That is, the above-mentioned conditions were practically controlled to try to obtain stable images by forming a toner image of a definite area (e.g., 10 mm×10 mm) on the surface of a photoreceptor, correctly measuring the change of the reflection density, determining the extent of deterioration of the photoreceptor by comparing the measured result with the initial value, and feeding back the result to the charging electric potential, the developing bias electric potential, etc. However, even when toner images each having a definite area were formed on the surface of a cylindrical photoreceptor under a same condition, the deviation of the reflection density became large, whereby a constant value was not obtained and it was difficult to sufficiently correct the images.

The reason is considered to be as follows: When a cylindrical photoreceptor is used, each toner image is not formed at the same position since the process starting position is located at an unspecified position on the photoreceptor in each process, thereby the distances between the surface of the photoreceptor and the processing units, such as the electrostatic charger, the sensor for detection and the developing roller, are changed in each position for forming the toner image due to the rotating deflection of the center axis for rotating the cylindrical photoreceptor, the tolerance of the mechanical dimensions of the cylindrical photoreceptor itself, and the rotation tolerance of the developing roller, and thus the reflection density is also changed.

For carrying out such a control process effectively, it is necessary at least to form each toner image at a definite position on the photoreceptor to keep a constant distance between the surface of the photoreceptor and each process unit. While there may be many means for detecting the specific position of the surface of the photoreceptor, examples thereof include a method of applying a marking to a rotating member corresponding to the rotation of a cylindrical photoreceptor and reading the marking with a sensor, and a method of applying a marking to the photoreceptor itself and reading the marking with a sensor. In any cases, in order to carry out the process control with a high reliability, it is necessary to make a marking such that the marking portion can be detected with high accuracy.

SUMMARY OF THE INVENTION

The present inventors have made intensive studies for overcoming the above-mentioned problems, and as a result, the present inventors have found that stable images of good quality can be obtained by using a cylindrical photoreceptor having a marking portion on the surface of the cylindrical electrically conductive substrate by a specific method such that the light reflectance is changed. This is achieved by starting the process from a definite position by detecting the specific position of the surface of the photoreceptor, indirectly measuring the deterioration due to the repeated use of the photoreceptor by forming a toner image at the specific position, and controlling the process condition relating to the photoreceptor to correct the image. The present invention has thus been succeeded.

An object of the present invention is to provide an electrophotographic photoreceptor capable of obtaining good image qualities same as the initial image quality even after the repeated use of the photoreceptor.

Another object of the present invention is to provide a method of producing the photoreceptor.

Further object of the present invention is to provide an image-correcting method using the photoreceptor.

Other objects and effects of the present invention will be apparent from the following description.

The present invention relates to an electrophotographic photoreceptor comprising a cylindrical electrically conductive substrate having thereon at least a photoconductive layer, the conductive substrate having a marking portion in which the light reflectance of the surface of the conductor substrate has been changed by a laser light treatment.

The present invention also relates to a method of producing an electrophotographic photoreceptor comprising a cylindrical electrically conductive substrate having thereon at least a photoconductive layer, the method comprising the steps of:

forming on the conductor substrate, a marking portion in which the light reflectance of the surface of the conductor substrate is changed by a laser light treatment; and forming a photoconductive layer on the conductive substrate including the marking portion.

The present invention further relates to an image correcting method comprising the steps of:

detecting a marking portion of an electrophotographic photoreceptor;

forming a toner image under a constant process condition at a definite position of the surface of the photoreceptor specified in relative relation with the marking portion;

detecting the density of the toner image; and controlling the electrophotographic process according to the result of the detection, the electrophotographic photoreceptor comprising a cylindrical electrically conductive substrate having thereon at least a photoconductive layer, the conductive substrate having the marking portion in which the light reflectance of the surface of the conductor substrate has been changed by a laser light treatment.

DETAILED DESCRIPTION OF THE INVENTION

In the present invention, a photoconductive layer is formed on a cylindrical electrically conductive substrate. Examples of the material of the cylindrical electrically conductive substrate include metallic materials such as aluminum, an aluminum alloy, stainless steel, copper, and nickel.

In the present invention, a laser light is used as a means for forming a marking portion by changing the light reflectance of a part of the surface of the cylindrical electrically conductive substrate. There is no particular restriction on the laser light source used in the present invention, and for example, an ordinary laser such as a YAG laser, a carbonic acid gas laser, etc., can be used.

The output condition of the laser light can be variously selected, and it is preferred in the present invention that the output condition of the laser light is selected such that the relative reflectance of the marking portion becomes not higher than 50, assuming that the reflectance of the non-marking portions of the surface of the electrically conductive substrate is 100. That is, it is preferred that the light reflectance of the marking portion is not higher than 50% of the light reflectance of the conductive substrate at the other portion than the marking portion (non-marking portion), in terms of a relative light reflectance.

For example, when an YAG laser is used, the laser output condition is preferably used at a frequency of from 2 to 10 KHz and an electric current of from 10 to 30 A.

Figure 1:
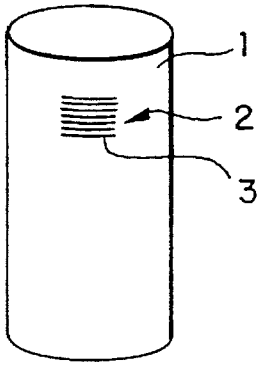
FIG. 1 is a schematic view showing an example on a marking portion on a cylindrical electrically conductive substrate.
Figure 2:
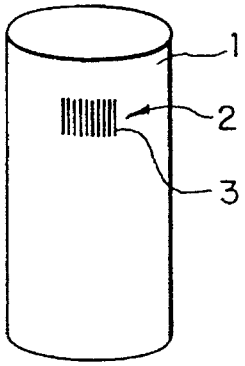
FIG. 2 is a schematic view showing another example of a marking portion on a cylindrical electrically conductive substrate.
Figure 3:
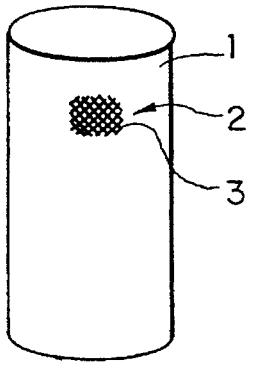
FIG. 3 is a schematic view showing still another example of a marking portion on a cylindrical electrically conductive substrate.

The scanning pattern in the case of irradiating the surface of a cylindrical electrically conductive substrate with a laser light under such an output condition is not particularly limited and may be various forms such as a parallel form, a perpendicular form and a slant lattice form, to the circumferential direction of the cylindrical electrically conductive substrate 1 as shown in FIGS. 1 to 3, respectively. Thus, a marking portion 2 of various forms such as a parallel form, a perpendicular form, a slant lattice form, etc., to the circumferential direction of the surface of the cylindrical electrically conductive substrate 1 corresponding to the scanning pattern can be formed at a part of the surface of the substrate 1.

Figure 4:
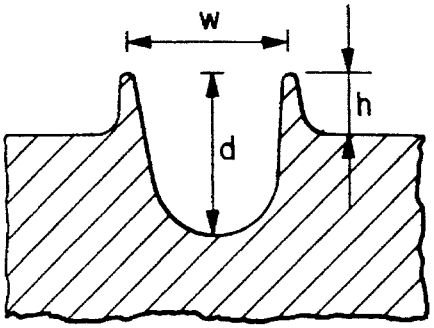
FIG. 4 is a schematic view showing a cross section of a groove-form marking composed of continuous dots.

The marking portion 2 thus formed comprises plurality of the marking groove 3 composed of continuous dots in the form of the scanning pattern and the light reflectance of the marking portion 2 is differentiated from the light reflectance of the non-marking portion. The marking groove 3 has edges on both sides of the groove, and the edge has a convex portion. The form of the cross section of the marking groove is usually as shown in FIG. 4. The height (h) of the convex portion of the edge is preferably from 3 to 10 μm, the depth (d) of the groove is preferably from 5 to 30 μm, and the width of the groove is generally from 50 to 150 μm, and preferably about 100 μm. On the central portion 4 of the marking groove, plural projections having a height of from about 2 to 100 μm are formed from the molten portion of the substrate at the irradiation of the laser light with a pitch corresponding to the output frequency of the laser light.

Figure 5:
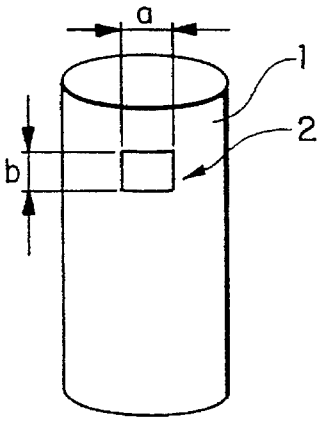
FIG. 5 is a schematic view showing a size of a marking portion.

There is no particular restriction on the size of the marking portion 2 thus formed, and it is preferred that the marking portion 2 has a length (a) in the circumferential direction of the cylindrical electrically conductive substrate 1 of from 5 to 50 mm and a width (b) of from 3 to 20 mm, as shown in FIG. 5.

Figure 6:
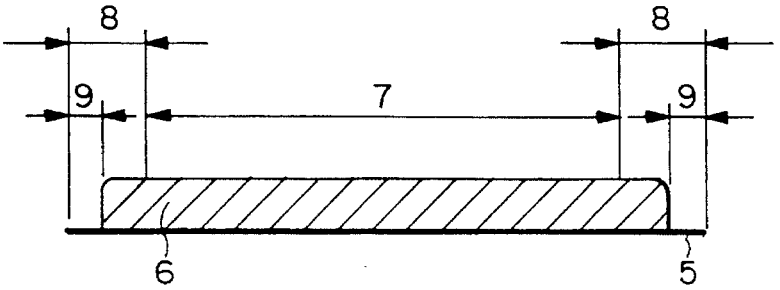
FIG. 6 is a schematic cross-sectional views of a photoconductive layer, an image-forming region, a region outside the image-forming region, and a region in contact with a developing gap holding jig.

The marking portion may be formed at the image-forming region 7 or at the outside 8 of the image-forming region, as long as the position is on the surface 5 of the substrate and under the photoconductive layer 6, as shown in FIG. 6. However, if the marking portion 2 is formed at the image-forming region 7, the marking portion 2 is liable to appear in the resulting images and hence it is preferred that the marking portion 2 is positioned at the outside 8 of the image-forming region.

In the case where the marking portion is formed at the outside 8 of the image-forming region, when a developing gap holding jig (such as a roller) for keeping the developing gap is used, the surface of the substrate in contact with the developing gap holding jig is roughened by the repeated use and hence it is preferred to form the marking portion outside the region 9 in contact with the developing gap holding jig. Furthermore, since the surface of the photoreceptor is contaminated with a developer and paper powder, it is preferred to form the marking portion 2 in the region of the substrate which is brought into contact with a cleaner, such as a cleaning blade, such that the light reflectance of the marking portion is not changed by the contamination after the initiation of the operation.

On the cylindrical electrically conductive substrate having the marking portion, a photoconductive layer is formed and the detection of the marking portion is carried out by using a reflectance detecting sensor through the photoconductive layer. The wavelength of the light used for the detecting sensor can be optionally selected. For reducing the influences of dusts in air, and stains and defects on the surface of the photoconductive layer as less as possible, it is preferred to use an infrared light having a wavelength, for example, of 850 nm and 900 nm.

In the present invention, a known barrier layer generally used for electrophotographic photoreceptors may be formed between the cylindrical electrically conductive substrate and the photoconductive layer.

Examples of the barrier layer include an inorganic layer such as an aluminum anodically oxide film, an aluminum oxide film, an aluminum hydroxide film, etc., and an organic layer such as the layers of polyvinyl alcohol, casein, polyvinyl pyrrolidone, polyacrylic acid, celluloses, gelatin, starch, polyurethane, polyimide, polyamide, etc.

Examples of the photoconductive layer include a layer of an inorganic photoconductive material such as selenium, an arsenic-selenium alloy, a selenium-tellurium alloy, amorphous silicon, etc.; an organic type photoconductive layer; and an inorganic-organic composite photoconductive layer.

Examples of the organic photoconductive layer include a laminated layer type photoconductive layer comprising at least a charge generating layer and a charge transfer layer, and a dispersion type photoconductive layer comprising particles of a charge generating material dispersed in a charge transfer medium.

In the case of the laminated layer type photoconductive layer, examples of the charge generating material used in the charge generating layer include inorganic photoconductive materials such as selenium, a selenium alloy, an arsenic-selenium alloy, cadmium sulfide, zinc oxide, etc.; and various kinds of organic pigments and dyes such as phthalocyanines, azo dyes, quinacridone, polycyclic quinones, pyrylium salts, thiapyrylium salts, indigo, thioindigo, anthoanthorone, pyranthorone, cyanine, etc. In these materials, metal-free phthalocyanine; phthalocyanines coordinated with a metal, a metal oxide, or a metal chloride, such as indium copper chloride, gallium chloride, tin chloride, oxytitanium, zinc, vanadium, etc.; and azo pigments such as monoazo, bisazo, trisazo and polyazo pigments.

The charge generating layer may be a dispersed layer formed by binding fine particles of the charge generating material with a binder resin such as a polyester resin, polyvinyl acetate, a polyacrylic acid ester, a polymethacrylic acid ester, polyester, polycarbonate, polyvinyl acetate acetal, polyvinyl propanol, polyvinyl butyral, a phenoxy resin, an epoxy resin, a urethane resin, a cellulose ester, a cellulose ether, etc. The amount of the charge generating material is generally in the range of from 30 to 500 parts by weight per 100 parts by weight of the binder resin. The thickness of the charge generating layer is generally from 0.1 to 2 μm, and preferable from 0.15 to 0.8 μm.

The charge generating layer may contain, if necessary, various additives such as a leveling agent, an antioxidant, a sensitizer, etc., for improving the coating property.

The charge generating layer may be a vapor-deposited layer of the charge generating material.

Examples of the charge transfer material used in the charge transfer layer include electron attracting compounds, e.g., 2,4,7-trinitrofluorenone and tetracyanoquinodimethane, and electron donating compounds, e.g., heterocyclic compounds (such as carbazole, indole, imidazole, oxazole, pyrazole, oxadiazole, pyrazoline and thiadiazole), amiline derivatives, hydrazone compounds, aromatic amine derivatives, stilbene derivatives, and polymers having groups derived from these compounds on the main chain or side chain thereof.

The charge transfer layer may be a dispersed layer formed by binding fine particles of a charge transfer material with a binder resin, such as vinyl polymers such as polymethyl methacrylate, polystyrene, polyvinyl chloride, copolymers thereof, polycarbonate, polyester, polyester carbonate, polysulfone, polyimide, a phenoxy resin, an epoxy resin, a silicone resin, and the partially crosslinked polymers thereof.

The amount of the charge transfer material is generally in the range of from 30 to 200 parts by weight, and preferable from 40 to 150 parts by weight, per 100 parts by weight of the binder resin.

The charge transfer layer may, if necessary, contain various additives such as an antioxidant, a sensitizer, etc.

The thickness of the charge transfer layer is generally from 10 to 60 μm, and preferably from 10 to 45 μm.

In the present invention, a known overcoat layer mainly composed of a thermoplastic polymer or a thermosetting polymer may be formed on the laminated layer type photoconductive layer as the uppermost layer.

The charge transfer layer is generally formed on the charge generating layer, but the charge generating layer may be formed on the charge transfer layer.

Examples of the method of forming the charge generating layer and the charge transfer layer include a known method of successively coating each coating composition obtained by dissolving or dispersing the materials being incorporated in the layer in a solvent can be applied.

In the case where the photoconductive layer is a dispersion type photoconductive layer, the charge generating material described above is dispersed in a matrix mainly composed of the binder resin and the charge transfer material at the compounding ratio as described above. In this case, it is necessary that the particle size of the charge generating material is sufficiently small. That is, the particle size thereof is preferably not larger than 1 μm, and more preferably not larger than 0.5 μm. If the amount of the charge generating material dispersed in the photoconductive layer is too small, a sufficient sensitivity may not be obtained, while the amount thereof is too large, there may occur the problems that the electrostatically charging property is lowered, and the sensitivity is lowered. Thus, the amount of the charge generating material is preferably from 0.5 to 50% by weight, and more preferably from 1 to 20% by weight, based on the total weight of the photoconductive layer.

The thickness of the dispersion type photoconductive layer is generally from 5 to 50 μm, and preferably from 10 to 45 μm. The dispersion type photoconductive layer may also contain a known plasticizer for improving the film-forming property, the flexibility, the mechanical strengths, etc.; an additive for restraining the residual potential; a dispersion aid for improving the dispersion stability; a leveling agent for improving the coating property, a surface active agent such as silicone oils, fluorine series oils, and the like.

As a method of correcting the deterioration of the images accompanied by the repeated use of the photoreceptor thus prepared, a method is preferably employed which comprises detecting the marking portion of the electrophotographic photoreceptor of the present invention; forming a toner image under a constant process condition at a definite position on the surface of the photoreceptor specified in relative relation with the marking portion; detecting the density of the toner image; and controlling the electrophotographic process according to the result of the detection.

For example, after reading the marking portion with a detecting sensor, the process is started from a specific position to form a toner image having a definite area at the position on the photoreceptor specified by relative relation with the marking portion, the reflection density of the toner image is determined with a density sensor, and the change of the reflection density is determined from the initial reflection density. Subsequently, the charging potential, the exposing amount, the developing bias potential, the toner density, etc., are changed to compensate the change of the reflection density of the toner image.

Since the marking portion in the present invention is formed by a laser light treatment, the marking portion always shows a stable surface property, and the position of the marking portion can be detected with good accuracy by a detecting sensor. Accordingly, by using the electrophotographic photoreceptor of the present invention having a marking portion, lowering of an image quality caused by the deterioration of the photoreceptor accompanied by the repeated use of the photoreceptor can be easily detected, and stable images can be always obtained by controlling the process conditions.

Furthermore, since the marking method used in the present invention is a dry process, the making portion scarcely gives influences on the characteristics of the photoreceptor when a photoconductive layer is formed on the substrate thereafter. The marking method used in the present invention can be easily applied to an automatic operation, and the marking portion can be easily formed on a substrate during the production of the electrophotographic photoreceptor.

The present invention is described in more detail below with reference to the examples and the comparative example, but the present invention is not construed as being limited to the examples.

EXAMPLE 1

An aluminum cylinder, as an electrically conductive substrate, having the outside diameter of 100 mm, the length of 340 mm, and the thickness of 2.0 mm specularly finished such that the maximum surface roughness of the surface thereof became 0.2 μS was irradiated by a YAG laser having a frequency of 3 KHz and an electric current of 18 A, (ML-4140A, trade name, manufactured by Miyachi Technos K.K.) at an area of 8 mm×8 mm to roughen the surface of the aluminum cylinder to form a marking portion. The marking portion was located outside the image-forming region, outside the developing gap holding jig contact region, and in the cleaning blade contact region and is 25 mm apart from one end of the aluminum cylinder. When the reflectance of the marking portion thus formed to a light having a wavelength of 890 nm was measured, the reflectance showed the relative value of 30% of the reflectance of the non-marking portion.

100 parts by weight of the bisazo compound having the structure shown below was added to 150 parts by weight of 4-methoxy-4-methylpentanone-2 and the mixture was subjected to a grinding and dispersing treatment by a sand grind mill.

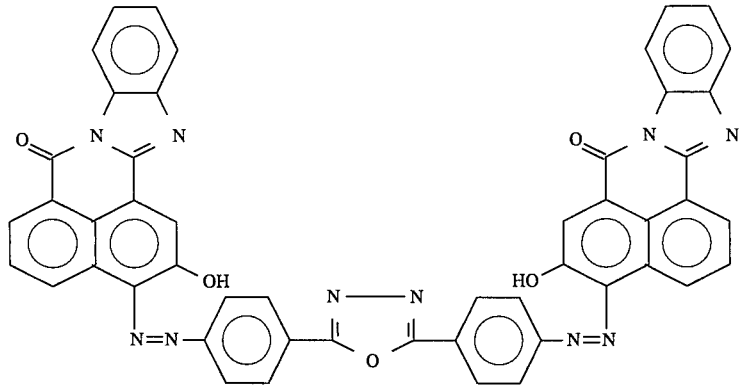

The pigment dispersion thus obtained was added to a 5% 1,2-dimethoxyethane solution of polyvinyl butyral (#6000-C, trade name, manufactured by DENKI KAGAKU KOGYO KABUSHIKI KAISHA) to finally provide a dispersion having a solid component concentration of 4.0%.

The aluminum cylinder described above was dip-coated with the dispersion thus obtained to form a charge generating layer having a dry thickness of 0.4 g/m$^2$ on the aluminum cylinder.

A charge generating layer was formed by dip-coating a solution obtained by dissolving 88 parts by weight of 5,5-diphenyl-2,4-pentadien-1-one-phenyl-α-naphthylpydrazone, 22 parts by weight of 1-pyrenecarbaldehye diphenylhydrazone, 100 parts by weight of the polycarbonate resin (viscosity average molecular weight: 22,000) having the repeating structure shown below,

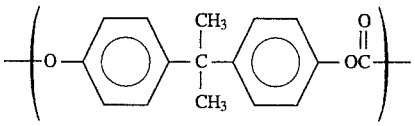

and 1.5 parts by weight of 4-(2,2-dicyanovinyl)phenyl-2,4,5-trichlorobenzenesulfonate in a mixed solvent of 1,4-dioxane and tetrahydrofuran, followed by drying for 30 minutes at room temperature and then for 30 minutes at 125° C. to a dry thickness of 35 μm.

The marking portion of the electrophotographic photoreceptor thus prepared was evaluated for detectability using a light reflectance sensor (emitting a light having a wavelength of 890 nm from an LED and detecting the reflected light from the photoreceptor with a phototransitor), and it was confirmed that the marking portion could be detected with very good accuracy.

EXAMPLE 2

A marking portion was formed in the same manner as in Example 1 on the same aluminum cylinder as in Example 1, except that the output conditions of the YAG laser were changed to a frequency of 6 KHz and an electric current of 25 A. When the reflectance of the marking portion thus formed to a light having a wavelength of 890 nm was measured, the reflectance showed a relative value of 15% of the reflectance of the non-marking portion.

A photoconductive layer was formed on the aluminum cylinder having the marking portion in the same manner as in Example 1 to provide an electrophotographic photoreceptor. The marking portion was evaluated for detectability in the same manner as in Example 1, and it was confirmed that the marking portion could be detected with a sufficient S/N and very good accuracy.

COMPARATIVE EXAMPLE

An aluminum cylinder, as an electrically conductive substrate, having the outer diameter of 100 mm, the length of 340 mm, and the thickness of 2.0 mm specularly finished such that the maximum surface roughness of the surface became 0.2 μS was applied a marking portion having an area of 8 mm×8 mm by toughening the surface thereof using a rubber grindstone (rotary.anglon common tool, manufactured by Miniter K.K.). The marking portion was located outside the image-forming region, outside the developing gap holding jig region, and in the cleaning blade contact region, and is 25 mm apart from one end of the aluminum cylinder. When the reflectance of the marking portion thus formed to a light having a wavelength of 890 nm was measured, the reflectance showed a relative value of 65% of the reflectance of the non-marking portion.

An electrophotographic photoreceptor was prepared in the same manner as in Example 1 using the resulting aluminum cylinder. The marking portion of the photoreceptor was evaluated for detectability using a light reflectance sensor (detecting light wavelength: 890 nm), and the S/N was inferior and the marking portion could not be detected with good accuracy.

EXAMPLE 3

The electrophotographic photoreceptor prepared in Example 1 was mounted on a copying machine equipped with a process control mechanism and a marking portion detecting sensor, and a copy test of 50,000 copies was carried out. Thereafter, the marking portion was evaluated, and the marking portion could be detected with sufficient accuracy. An image of a standard white plate was then printed on a specific position of the surface of the photoreceptor with the marking portion as a standard, and a toner image was formed. When the density of the toner image was read by the detecting sensor and the correction of image was carries out by changing the developing bias potential according to the result of the detection, images having the same image quality as that of the initial image could be obtained.

EXAMPLE 4

An aluminum cylinder, as an electrically conductive substrate, having the outside diameter of 80 mm, the length of 340 mm, and the thickness of 2.0 mm specularly finished such that the maximum surface roughness of the surface thereof became, 0.2 μS was degreased by washing in a 30 g/l aqueous solution of a degreasing agent (NG-#30, trade name, manufactured by Kizai Co., Ltd.) followed by washed with water, and then anodically oxidized in a 180 g/l sulfuric acid electrolyte (aluminum ion cncentration: 7 g/l) at a current density of 1.2 A/dm$^2$, to form an anodically oxidized film having an average thickness of 6 μm. After washed with water, the aluminum cylinder was subjected to sealing treatment by immersing in a 10 g/l aqueous solution of a high temperature sealant mainly composed of nickel acetate (Top Seal DX-500, trade name, manufactured by Okuno Seiyaku Co., Ltd.) at 95° C. for 30 minutes. The aluminum cylinder was then washed with water with applying ultrasonic waves, followed by drying.

The resulting aluminum cylinder as a conductive substrate was irradiated by a YAG laser having a frequency of 3 KHz and an electric current of 18 A, (ML-4140A, trade name, manufactured by Miyachi Technos K.K.) at an area of 8 mm×8 mm to roughen the surface of the aluminum cylinder to form a marking portion. The marking portion was located outside the image-forming region, outside the developing gap holding jig contact region, and in the cleaning blade contact region and is 25 mm apart from one end of the aluminum cylinder. When the reflectance of the marking portion was measured, the reflectance showed the relative value of 40% of the reflectance of the non-marking portion.

500 parts by weight of 1,2-dimethoxyethane was added to 10 parts by weight of oxytitanium-phthalocyanine and 5 parts by weight of polyvinyl butyral (Denka Butyral 6000C, trade name, manufactured by Denki Kagaku Kogyo Co., Ltd.), the mixture obtained was dispersed in a sand grinding mill. The resulting dispersion was dip-coated on the above aluminum cylinder having an anodically oxidized film, to form a charge generating layer having a dry thickness of 0.4 μm.

56 parts by weight of N-methylcarbazole-3-carbaldehyde diphenylhydrazone, 14 parts by weight of 3,3-di(4-methoxyphenyl)acrolein diphenylhydrazone, 1.5 parts by weight of 4-(2,2-dicyanovinyl)phenyl-2,4,5'-trichlorobenzenesulfonate, and 100 parts by weight of a polycarbonate resin (Novarex 7030A, trade name, manufactured by Mitsubishi Kasei Corporation) were dissolved in 1,000 parts by weight of 1,4-dioxiane. The resulting solution was dip-coated on the aluminum cylinder having a charge generating layer to form a charge transfer layer having a dry thickness of 20 μm.

The marking portion of the electrophotographic photoreceptor thus prepared was evaluated for detectability using a light reflectance sensor (emitting a light having a wavelength of 890 nm from an LED and detecting the reflected light from the photoreceptor with a phototransitor), and it was confirmed that the marking portion could be detected with very good accuracy.

While the invention has been described in detain and with reference to specific examples thereof, it will be apparent to one skilled in the art that various changes and modifications can be made therein without departing from the spirit and scope thereof.

What is claimed is:

1. An image correcting method comprising the steps of:

detecting a marking portion of an electrophotographic photoreceptor;

forming a toner image under a constant process condition at a definite position on the surface of said photoreceptor specified in relative relation with said marking portion;

detecting the density of said toner image; and controlling the electrophotographic process according to the result of said detection, said electrophotographic photoreceptor comprising a cylindrical electrically conductive substrate having thereon at least a photoconductive layer, said conductive substrate having said marking portion in which the light reflectance of the surface of said conductor substrate has been changed by a laser light treatment, wherein said marking portion is positioned on said cylindrical electrically conductive substrate at a location outside of an image-forming region.

2. An image correcting method as claimed in claim 1, wherein a reflection detecting sensor using an infrared light is used for detecting said marking portion.

* * * * *